US008786171B2

(12) United States Patent
Zhou et al.

(10) Patent No.: US 8,786,171 B2
(45) Date of Patent: Jul. 22, 2014

(54) FIELD EMISSION LIGHT SOURCE DEVICE AND MANUFACTURING METHOD THEREOF

(75) Inventors: Mingjie Zhou, Shenzhen (CN); Wenbo Ma, Shenzhen (CN); Qingtao Li, Shenzhen (CN)

(73) Assignee: Ocean's King Lighting Science & Technology Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 13/821,512

(22) PCT Filed: Sep. 20, 2010

(86) PCT No.: PCT/CN2010/077155

§ 371 (c)(1),
(2), (4) Date: Mar. 7, 2013

(87) PCT Pub. No.: WO2012/037718

PCT Pub. Date: Mar. 29, 2012

(65) Prior Publication Data

US 2013/0169143 A1 Jul. 4, 2013

(51) Int. Cl.

| | |
|---|---|
| ***H01J 63/04*** | (2006.01) |
| ***H01J 1/62*** | (2006.01) |
| ***H01J 1/90*** | (2006.01) |
| *H01J 61/30* | (2006.01) |
| *H01J 63/02* | (2006.01) |
| *H01J 63/06* | (2006.01) |
| *H01J 9/24* | (2006.01) |
| *H01J 9/38* | (2006.01) |

(52) U.S. Cl.

CPC .. *H01J 1/90* (2013.01); *H01J 61/30* (2013.01); *H01J 63/02* (2013.01); *H01J 63/06* (2013.01); *H01J 9/24* (2013.01); *H01J 9/38* (2013.01)

USPC ..... 313/495; 313/483

(58) Field of Classification Search

None

See application file for complete search history.

(56) References Cited

U.S. PATENT DOCUMENTS

| | | | | |
|---|---|---|---|---|
| 6,051,923 | A | 4/2000 | Pong | |
| 6,873,095 | B1 * | 3/2005 | Kjellman et al. | 313/336 |
| 7,456,564 | B2 * | 11/2008 | Song et al. | 313/497 |
| 7,638,935 | B2 * | 12/2009 | Liu et al. | 313/491 |
| 7,812,512 | B2 * | 10/2010 | Nishimura et al. | 313/495 |
| 2007/0164657 | A1 * | 7/2007 | Lee et al. | 313/497 |
| 2009/0066216 | A1 * | 3/2009 | Fu et al. | 313/495 |

FOREIGN PATENT DOCUMENTS

| | | | |
|---|---|---|---|
| JP | S57119452 | A | 7/1982 |
| JP | S6339983 | A | 2/1988 |
| JP | 2003-506824 | A | 2/2003 |
| JP | 2003-346707 | A | 12/2003 |
| JP | 2005-322651 | A | 11/2005 |

(Continued)

*Primary Examiner* — Natalie Walford

(74) *Attorney, Agent, or Firm* — Shimokaji & Associates P.C.

(57) ABSTRACT

A field emission light source device, comprising: cathode plate comprising substrate and cathode conductive layer disposed on surface of substrate, and anode plate comprising base formed from transparent ceramic material and anode conductive layer disposed on one surface of base, and insulating support member by which cathode plate and anode plate are integrally fixed, and vacuum-tight chamber formed with anode plate, cathode plate and insulating support member; anode conductive layer and the cathode plate are disposed opposite each other. Because of advantages of good electrical conductivity, high light transmittance, stable electron-impact resistance performance and uniform luminescence, using transparent ceramic as the base of the anode plate in the field emission light source device can increase electron beam excitation efficiency effectively, increase light extraction efficiency of the field emission light source device, and finally increase its luminous efficiency. A manufacturing method of the field emission light source device is also provided.

3 Claims, 2 Drawing Sheets

(56) References Cited

FOREIGN PATENT DOCUMENTS

| | | | |
|---|---|---|---|
| JP | 2006-040866 | A | 2/2006 |
| JP | 2006-164854 | A | 6/2006 |
| JP | 2007-188874 | A | 7/2007 |
| JP | 2009-087775 | A | 4/2009 |
| JP | 2010-192245 | A1 | 9/2010 |

* cited by examiner

FIELD EMISSION LIGHT SOURCE DEVICE AND MANUFACTURING METHOD THEREOF

FIELD OF THE INVENTION

The present invention relates to vacuum electron devices. More specifically, the present invention relates to a field emission light source device and manufacturing method thereof.

BACKGROUND OF THE INVENTION

Field emission light source, an emerging light source having features of large current density, low power consumption, fast responding, etc, has important application prospects in the field of flat-panel display, X-ray source, microwave amplifier and other vacuum electronics fields. The working principle of field emission source is: in the electric field, metal tip at low potential, carbon nano tube and other electron emitters emit electrons that strike phosphor at high potential to produce visible light.

Traditional field emission light source device which has advantages of low operating voltage, no warm-up delay, being highly integrated, energy saving, being environmentally friendly, quick start, being thin and light, good environmental suitability, etc, is mainly used in the field of lighting and display. And, as a new generation of light source in the field of lighting, field emission light source device is developing rapidly owing to its advantages of mercury-free, low energy consumption, uniform luminescence and adjustable light intensity. Conventional field emission light source device mainly uses phosphor as anode, where electron beams strike phosphor that produces visible light under the excitation of electron beams. Sulfides, oxides or silicate phosphor are commonly used as anode luminous materials.

Oxides or silicate phosphor has relatively low electrical conductivity, and is prone to produce charge accumulation at anode under the strike of electron beams, bringing a decrease of potential difference between the two electrodes and an impact on luminous efficiency of field emission light source device. However, in the anode plate using sulfides phosphor having good electrical conductivity, decomposition of sulfides may occur easily and emit gas, which not only decreases the vacuum degree of field emission light source device but poisons the cathode, and ultimately shortens the life of a field emission device.

SUMMARY OF THE INVENTION

In view of this, it is necessary to develop a field emission light source device with high luminous efficiency, having an anode plate of good electrical conductivity, stable electron-impact resistance performance.

A field emission light source device, comprising an anode plate and a cathode plate spaced apart from each other, and an insulating support member by which said anode plate and said cathode plate spaced apart from each other are integrally fixed, said cathode plate comprises a substrate and a cathode conductive layer disposed on a surface of said substrate, a vacuum-tight chamber is formed with said anode plate, said cathode plate and said insulating support member; said anode plate comprises a base formed from transparent ceramic material and an anode conductive layer disposed on one surface of said base, said anode conductive layer and the cathode plate are disposed opposite each other.

Preferably, said transparent ceramic is $Y_2O_3$:Eu transparent ceramic, $Y_2O_2S$:Eu transparent ceramic, $Y_2SiO_5$:Tb transparent ceramic, $Gd_2O_2S$:Tb transparent ceramic, $LaAlO_3$:Tm transparent ceramic or $LaGaO_3$:Tm transparent ceramic; said transparent ceramic has a visible light transmittance greater than 50%.

Preferably, said anode conductive layer is an aluminium thin film layer of 20 nm to 200 μm thick.

Preferably, said anode plate is a spherical shell having a diameter of 100 mm, said cathode plate is disposed on the centre of said spherical shell chamber.

Preferably, said anode plate is a curved shell having a chord of 50 mm, configuration of said cathode plate is consistent with the internal surface of said curved shell, said cathode plate is disposed in parallel with the internal surface of said curved shell.

Preferably, the material of said insulating support member is $Al_2O_3$ or $ZrO_2$.

Preferably, said cathode conductive layer comprises indium tin oxide thin film layer and carbon nano tube layer, said indium tin oxide thin film layer is disposed on a surface of said substrate, said carbon nano tube layer is disposed on a surface of said indium tin oxide thin film layer.

A manufacturing method of the field emission light source device, comprising:

preparing a base formed from transparent ceramic, and disposing a anode conductive layer on one surface of said base to obtain anode plate;

preparing a cathode conductive layer on one surface of the substrate to obtain said cathode plate;

disposing said anode plate and said cathode plate spaced apart from each other, and disposing said cathode plate and anode conductive layer on said anode plate opposite each other; next, fixing integrally said cathode plate and said anode plate by an insulating support member to form a chamber with said anode plate, said cathode plate and said insulating support member;

vacuum sealing the chamber formed with said cathode plate, said anode plate and said insulating support member to obtain said field emission light source device.

Preferably, said preparation of said anode plate further comprises a step of cleaning, comprising: sonicating transparent ceramic successively with acetone, absolute ethanol, deionized water, and then air-drying; said anode conductive layer is disposed on a surface of said base by magnetron sputtering or evaporation technique;

said preparation of said cathode plate further comprises a step of cleaning, comprising: sonicating said substrate successively with acetone, absolute ethanol, deionized water, and then air-drying; said cathode conductive layer is disposed on said substrate by magnetron sputtering technique;

in said step of sealing, the material used for sealing is glass pastes having a melting point of 380° C. to 550° C.

Preferably, said step of sealing further comprises a treatment of placing a getter in exhaust pipe during the vacuum treatment.

By using transparent ceramic as the base of the anode plate and taking its advantages of good electrical conductivity, high light transmittance, stable electron-impact resistance performance and uniform luminescence, electron beam excitation efficiency and light extraction efficiency of a field emission light source device can be increased, resulting in improvement of luminous efficiency of a field emission light source device.

DETAILED DESCRIPTION OF ILLUSTRATED EMBODIMENTS

Figure 1:
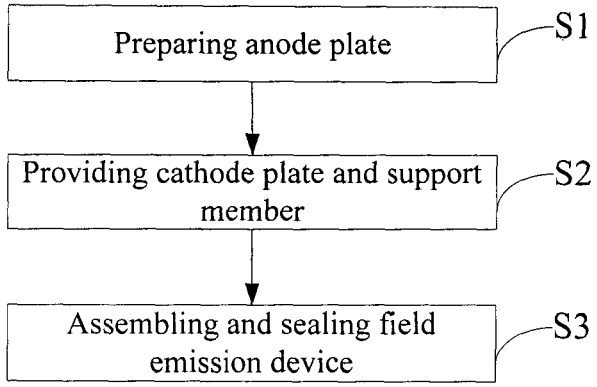
FIG. 1 is a flow chart of manufacturing field emission light source device of one embodiment.

Further description of field emission light source device and manufacturing method thereof of the present invention will be illustrated, which combined with embodiments and drawings.

In one embodiment, field emission light source device comprises an anode plate and a cathode plate spaced apart from each other, and an insulating support member by which the anode plate and the cathode plate spaced apart from each other are integrally fixed, a vacuum-tight chamber is formed with the anode plate, the cathode plate and the insulating support member, the anode plate comprises a base and an anode conductive layer disposed on one surface of the base, the cathode plate comprises a substrate and a cathode conductive layer disposed on a surface of the substrate, the anode conductive layer and the cathode plate are disposed opposite each other.

The material of base is transparent ceramic, for example, $Y_2O_3$:Eu transparent ceramic, $Y_2O_2S$:Eu transparent ceramic, $Y_2SiO_5$:Tb transparent ceramic, $Gd_2O_2S$:Tb transparent ceramic, $LaAlO_3$:Tm transparent ceramic, $LaGaO_3$:Tm transparent ceramic, etc; said transparent ceramic has a visible light transmittance greater than 50%.

Herein, the symbol ":" indicates that the latter is used to dope the former, for example, $Y_2O_3$:Eu means $Y_2O_3$ doped with Eu.

Said field emission light source device, using transparent ceramic as the base of the anode plate and taking its advantages of good electrical conductivity, high light transmittance, stable electron-impact resistance performance and uniform luminescence, can increase electron beam excitation efficiency and light extraction efficiency of a field emission light source device, resulting in improvement of luminous efficiency of a field emission light source device; in addition, such field emission light source device are in line with the development trends toward energy saving and environmental protection, has good prospects.

The thickness of anode conductive layer is in the range of 20 nm to 200 μm, the material of anode conductive layer is selected from metals having good electrical conductivity, such as Ag, Au, Cu, Al and others, Al is preferred.

The material of support member is one of $Al_2O_3$ and $ZrO_2$.

Anode plate is transparent member having a certain radius of curvature, anode plate can be a spherical shell having a diameter of 100 mm, anode plate is disposed on the centre of the spherical shell chamber; anode plate can also be a curved shell having a chord of 50 mm, configuration of the cathode plate is consistent with the internal surface of the curved shell, that is the two are different in proportion but similar in the shape, the cathode plate is disposed in parallel with the internal surface of the curved shell.

Cathode plate comprises substrate and cathode conductive layer disposed on a surface of the substrate; the cathode conductive layer comprises indium tin oxide thin (ITO) film layer and carbon nano tube (CNT) layer, the ITO thin film layer is disposed on a surface of the substrate, the CNT layer is disposed on a surface of the ITO thin film layer.

With the curve design of anode formed from transparent ceramic, the light extraction efficiency of a field emission light source device is increased, thus improving the luminous efficiency of a field emission light source device.

FIG. 1 shows a flow chart of manufacturing said field emission light source device, comprising:

S1, preparing anode plate

Preparing transparent ceramic shell;

sonicating transparent ceramic successively with acetone, absolute ethanol, deionized water, and then air-drying to obtain cleaned transparent ceramic shell;

evaporating or magnetron sputtering anode conductive layer on a surface of cleaned transparent ceramic shell to obtain anode.

S2, providing cathode plate and support member;

Providing a proper substrate, polishing it on both sides, then sonicating successively with acetone, absolute ethanol, deionized water, and then air-drying. After that, magnetron sputtering an ITO thin film on its surface, finally, printing or growing a CNT thin film on a surface of ITO thin film to obtain cathode plate.

Generally, CNT cathode can be directly purchased on the market.

Providing a support member formed from $Al_2O_3$ or $ZrO_2$, sonicating successively with acetone, absolute ethanol, deionized water, and then air-drying.

S3, assembling and sealing field emission device

Disposing anode plate and cathode plate spaced apart from each other, and disposing the cathode plate and anode conductive layer on the anode plate opposite each other; next, fixing integrally the cathode plate and the anode plate by an insulating support member to form a chamber with said anode plate, said cathode plate and said insulating support member, the assembling is finished.

Coating glass pastes having a melting point of 380° C. to 550° C. among the cathode plate, anode plate and insulating support member, heat sealing at 380° C. to 550° C., then placing the sealed field emission device into exhausting machine, adding a getter into exhaust pipe, vacuumizing to $1\times10^{-5}$~$9.9\times10^{-5}$ Pa, obtaining sealed field emission device.

Specific embodiments will be described below in detail.

Example 1

Figure 2:
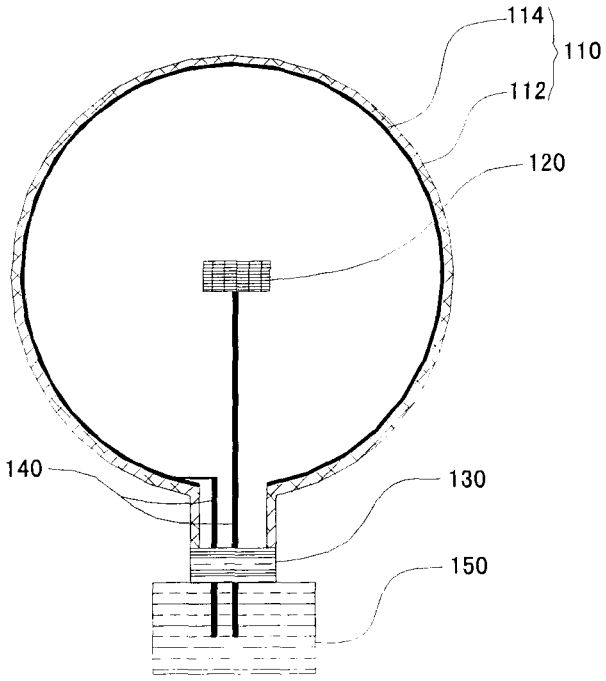
FIG. 2 is a sectional view of field emission light source device of Example 1.

FIG. 2 shows a structure diagram of field emission light source device of Example 1, comprising a spherical anode plate 110 having a diameter of 100 mm, cathode plate 120 in the size of 70×60×25 mm, insulating support member 130, wires 140 and powder supply 150. The spherical anode plate 110 comprises a base 112 and anode conductive layer 114 disposed on the internal surface of the base 112. Cathode plate 120 is disposed on the centre of the spherical anode plate 110. Cathode plate 120 comprises ITO thin film layer disposed on a surface of the substrate and CNT layer disposed on the ITO thin film layer. Anode plate 110 and cathode plate 120 are spaced apart from each other and fixed by support member 130. Two wires 140 cross the support member 130, whose one end is connected to anode conductive layer 114 and cathode conductive layer 120, the other end is connected to powder supply 150.

$Al_2O_3$ is used as the material of support member 130 for insulating and fixing; in other embodiments, $ZrO_2$ can also be used as the material of support member.

Material of the base 112 can be $Y_2O_3$:Eu transparent ceramic, whose visible light transmittance is greater than 50%, in other embodiments, $Y_2O_2S$:Eu transparent ceramic, $Y_2SiO_5$:Tb transparent ceramic, $Gd_2O_2S$:Tb transparent ceramic, $LaAlO_3$:Tm transparent ceramic or $LaGaO_3$:Tm transparent ceramic can also be used as the material of the base.

Thickness of the anode conductive layer 114 is 200 μm, the material is Al, in other embodiments, Ag, Au, Cu and other metals of good electrical conductivity can also be used.

The manufacturing method of said field emission device, comprising:

Preparing Anode Plate 110

Making $Y_2O_3$:Eu transparent ceramic into a 100 mm spherical shell having a diameter of 100 mm served as the base 112 of anode plate, then polishing the surface. After that, sonicating $Y_2O_3$:Eu transparent ceramic successively with acetone, absolute ethanol, deionized water for 20 min, and then air-drying the cleaned $Y_2O_3$:Eu transparent ceramic. Evaporating or magnetron sputtering an Al film served as anode conductive layer 114 on the internal surface of $Y_2O_3$:Eu transparent ceramic.

Preparing Cathode Plate 120

Cutting a base into the size of 70×60×25 mm, polishing both sides, sonicating successively with acetone, absolute ethanol, deionized water, and then air-drying. After that, magnetron sputtering an ITO thin film on its surface, finally, printing or growing a CNT thin film on a surface of ITO thin film.

Assembling and Sealing

Coating the prepared glass pastes having low melting point among the anode plate 110, cathode plate 120 and support member 130, heating to 380° C. and maintaining for 90 min to seal the device. Then placing the sealed field emission device into exhausting machine, adding a getter into exhaust pipe, vacuumizing to $1\times10^{-5}$ Pa, toasting to finish sealing, at last, assembling wires 140 and powder supply 150, obtaining the field emission device.

Example 2

Figure 3:
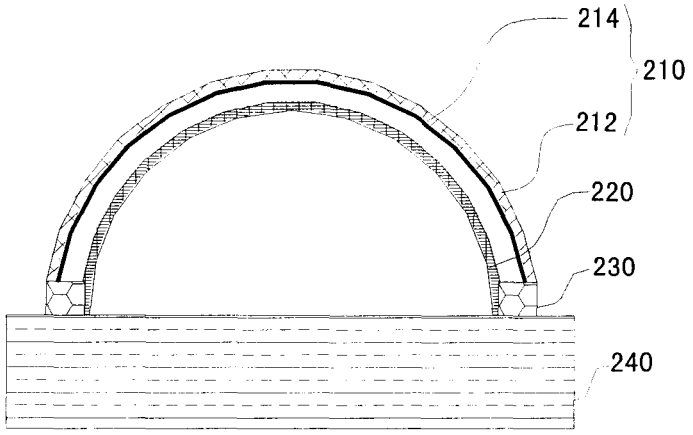
FIG. 3 is a sectional view of field emission light source device of Example 2.

FIG. 3 shows a structure diagram of field emission light source device of Example 2, comprising a curved anode plate 210 having a chord of 50 mm, cathode plate 220, insulating support member 230 and powder supply 240. The anode plate 210 comprises a base 212 and anode conductive layer 214 disposed on the base. The configuration of cathode plate 220 is generally consistent with the internal surface of anode plate 210, and cathode plate 220 is disposed in parallel with the internal surface of anode plate 210. Cathode plate 220 comprises ITO thin film layer disposed on a surface of the substrate and CNT layer disposed on the ITO thin film layer. Anode plate 210 and cathode plate 220 are spaced apart from each other and fixed on the shell of power supply 240 by support member 230.

$ZrO_2$ is used as the material of support member 230 for insulating and fixing; in other embodiments, $Al_2O_3$ can also be used as the material of support member.

Material of the base 212 can be $Y_2SiO_5$:Tb transparent ceramic, whose visible light transmittance is greater than 50%, in other embodiments, $Y_2O_3$:Eu transparent ceramic, $Y_2SiO_5$:Tb transparent ceramic, $Gd_2O_2S$:Tb transparent ceramic, $LaAlO_3$:Tm transparent ceramic or $LaGaO_3$:Tm transparent ceramic can also be used as the material of the base.

Thickness of the anode conductive layer 214 is 20 nm, the material is Al, in other embodiments, Ag, Au, Cu and other metals of good electrical conductivity can also be used.

The manufacturing method of said field emission device, comprising:

Preparing anode plate 210: according to a certain radius of curvature and 50 mm length of chord, manufacturing $Y_2SiO_5$:Tb transparent ceramic served as base 212, polishing then sonicating $Y_2SiO_5$:Tb transparent ceramic successively with acetone, absolute ethanol, deionized water for 20 min, and then air-drying the cleaned $Y_2SiO_5$:Tb transparent ceramic. Evaporating or magnetron sputtering an Al film served as anode conductive layer 214 on the internal surface of $Y_2SiO_5$:Tb transparent ceramic.

Preparing cathode plate 220: providing a 55×55 mm substrate, polishing both sides, sonicating successively with acetone, absolute ethanol, deionized water, and then air-drying. After that, magnetron sputtering an ITO thin film on its surface, finally, printing or growing a CNT thin film on a surface of ITO thin film.

Assembling and Sealing coating the prepared glass pastes having low melting point among the anode plate 210, cathode plate 220 and support member 230, heating to 550° C. and maintaining for 5 min to seal the device. Then placing the sealed field emission device into exhausting machine, adding a getter into exhaust pipe, vacuumizing to $9.9\times10^{-5}$ Pa, toasting to finish sealing, at last, assembling powder supply 240, obtaining the field emission device.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the spirit and scope of the present invention. Accordingly, the scope of the present invention is described by the appended claims and is supported by the foregoing description.

What is claimed is:

1. A manufacturing method of field emission light source device, comprising:

preparing a base formed from transparent ceramic, and disposing a anode conductive layer on one surface of said base to obtain anode plate;

preparing a cathode conductive layer on one surface of substrate to obtain cathode plate;

disposing said anode plate and said cathode plate spaced apart from each other, and disposing said cathode plate and anode conductive layer on said anode plate opposite each other; next, fixing integrally said cathode plate and said anode plate by an insulating support member to form a chamber with said anode plate, said cathode plate and said insulating support member;

vacuum sealing the chamber formed with said cathode plate, said anode plate and said insulating support member to obtain said field emission light source device;

wherein, said preparation of said anode plate further comprises a step of cleaning, comprising: sonicating transparent ceramic successively with acetone, absolute ethanol, deionized water, and then air-drying; said anode conductive layer is disposed on a surface of said base by magnetron sputtering or evaporation technique;

said preparation of said cathode plate further comprises a step of cleaning, comprising: sonicating said substrate successively with acetone, absolute ethanol, deionized water, and then air-drying; said cathode conductive layer is disposed on said substrate by magnetron sputtering technique;

in said step of sealing, the material used for sealing is glass pastes having a melting point of 380° C. to 550° C.

2. A manufacturing method of field emission light source device, comprising:

preparing a base formed from transparent ceramic, and disposing a anode conductive layer on one surface of said base to obtain anode plate;

preparing a cathode conductive layer on one surface of substrate to obtain cathode plate;

disposing said anode plate and said cathode plate spaced apart from each other, and disposing said cathode plate and anode conductive layer on said anode plate opposite each other; next, fixing integrally said cathode plate and said anode plate by an insulating support member to form a chamber with said anode plate, said cathode plate and said insulating support member;

vacuum sealing the chamber formed with said cathode plate, said anode plate and said insulating support member to obtain said field emission light source device;

wherein said step of sealing further comprises a treatment of placing a getter into exhaust pipe during the vacuum treatment.

3. The manufacturing method of the field emission light source device as claimed in the claim 1, wherein said step of sealing further comprises a treatment of placing a getter into exhaust pipe during the vacuum treatment.

* * * * *